United States Patent [19]

Baker et al.

[11] Patent Number: 4,755,420

[45] Date of Patent: Jul. 5, 1988

[54] DRYER FABRIC HAVING WARP STRANDS MADE OF MELT-EXTRUDABLE POLYPHENYLENE SULPHIDE

[75] Inventors: Samuel M. Baker, Carleton Place; F. Brian Best, Ottawa, both of Canada; Girish M. Bhatt, Williston, Vt.

[73] Assignee: JWI Ltd., Ontario, Canada

[21] Appl. No.: 822,107

[22] Filed: Jan. 24, 1986

Related U.S. Application Data

[63] Continuation-in-part of Ser. No. 727,665, Apr. 26, 1985, abandoned, which is a continuation-in-part of Ser. No. 605,825, May 1, 1984, abandoned.

[51] Int. Cl.[4] ..... D03D 13/00

[52] U.S. Cl. ..... 428/222; 139/383 A; 139/420 A; 428/419

[58] Field of Search ..... 139/383 A, 420 A; 428/245, 259, 222, 419

[56] References Cited

U.S. PATENT DOCUMENTS 3,919,177 11/1975 Campbell .

*Primary Examiner*—Marion C. McCamish

*Attorney, Agent, or Firm*—Oblon, Fisher, Spivak, McClelland & Maier

[57] ABSTRACT

A dryer fabric for use in a dryer section of a paper machine wherein at least a portion of the machine direction components are monofilaments made from polyphenylene sulphide or a blend of polyphenylene sulphide and heat-stabilized polyamide 66. When using a blend the polyamide 66 is present in the range of up to about 20% by weight.

15 Claims, 3 Drawing Sheets

DRYER FABRIC HAVING WARP STRANDS MADE OF MELT-EXTRUDABLE POLYPHENYLENE SULPHIDE

This is a continuation-in-part application U.S. patent application Ser. No. 06/727,665 filed Apr. 26, 1985 entitled "DRYER FABRIC HAVING WARP STRANDS MADE OF MELT-EXTRUDABLE POLYPHENYLENE SULPHIDE" now abandoned which is itself a continuation-in-part application of U.S. patent application Ser. No. 06/605,825 filed May 1, 1984 having the same title now abandoned.

BACKGROUND OF INVENTION

1. Field of the Invention

The present invention relates to fabrics made of synthetic materials and particularly, but not exclusively, for use in dryer sections of papermaking machines involving high temperature.

2. Description of Prior Art

Increasingly dryer fabrics are being manufactured from monofilament strands because such fabrics are easier to keep clean, thus retaining their drying efficiency, and because they are essentially non-absorptive. These are normally of woven construction, but in recent years an alternative non-woven construction is becoming popular—the so-called "spiral fabrics"—which are assembled from a multiplicity of helical coils connected together by inserted hinge pins. German patent DE No. 2419751 and U.S. Pat. No. 4,481,079 describe this type of fabric. The predominant material used in such fabrics, whether woven or spiral, is polyester, with polyamides used less frequently. Unfortunately, both of these classes of materials degrade at high temperature, a shortcoming which precludes their use in high temperature applications on paper machines. High temperature applications are ones that result in operating temperatures of about 150° C. or above.

In some applications, large temperature differences are established in the fabrics. Where this happens, the degradation will be the most severe where the temperature is the highest. One example is where the most severe degradation occurs at the edges of the fabric which extend beyond the paper web and accordingly are in direct contact with the heated dryer cans. Another example is in paper machine dryer sections where a single felted configuration is used. This configuration is described in FIG. 2 of U.S. Pat. No. 4,290,209. In such cases, one surface of the fabric is in direct contact with the heated dryer cans as it progresses through the dryer section. The most severe degradation of these fabrics occurs at that surface which is in contact with the dryer cans.

Also, chemical contamination such as oil and grease or chemicals used in papermaking can cause increased degradation. This contamination is often localized. In the case of oil and grease, it is generally located at the edges of the fabric. In the case of papermaking chemicals, it is often localized to the surface of the fabric that is in contact with the paper web.

Some manufacturers of woven fabrics have resorted to NOMEX or KEVLAR in order to cope with the extreme conditions prevalent in such high temperature applications. Because neither polymer is melt-extrudable, monofilaments made from them are not practicable and so these materials are employed in the form of composite multifilaments, often resin coated. U.S. Pat. No. 4,159,618 teaches such a monofilament-like composite strand for this purpose, but even these composites are deficient in that they lose tensile strength when exposed to moist or dry heat (see Tables 1–3 in U.S. Pat. No. 4,159,618).

Considering now another property of dryer fabrics, it is highly desirable that such fabrics be distortion resistant, that is, have inherent dimensional stability and retain this property so as to resist skewing throughout their life on the paper machine. Woven fabrics made with monofilament warp of round cross-section and conventional materials such as polyester, while having the desirable advantages of running clean and of non-absorptivity already mentioned, are generally deficient in distortion resistance because of the minimal interlocking contact at the warp and weft cross-overs dictated by the geometry of the respective strands. U.S. Pat. No. 4,290,209 discloses the use of rectangular cross-section warp strands having a flattening ratio of about 2:1, whereby the resulting fabric acquires superior properties of distortion resistance and surface smoothness, along with more desirable permeability and elastic modulus. None of these improved fabrics, however, are suitable for high temperature applications, again because of the inherent tendency of the polymers normally used to degrade and lose strength.

U.S. Pat. No. 4,359,501 discloses an industrial fabric, for use in applications involving elevated temperatures, comprised of melt-extrudable polyaryletherketone monofilament strands. This material, however, suffers the major disadvantage of being so costly that the woven end product is not economically attractive to the specific paper mill end-users already identified.

The present invention is directed towards solving these problems.

SUMMARY OF INVENTION

Broadly, the present invention provides a dryer fabric for use in a dryer section of a paper machine wherein at least a portion of the machine direction components of the fabric are monofilaments made from polyphenylene sulphide or a blend of polyphenylene sulphide with heat-stabilized polyamide 66 with the polyamide 66 being present in the range of up to about 20% by weight.

In a preferred embodiment of the invention, the polyphenylene sulphide is blended with about 6% by weight of heat-stabilized polyamide 66.

In another preferred embodiment the dryer fabric comprises a plurality of interwoven warp and weft strands wherein at least a portion of the warps are monofilaments made from polyphenylene sulphide or a blend of polyphenylene sulphide with heat-stabilized polyamide 66, the warp strands having an essentially rectangular cross-section with the long axis of the rectangle lying in the plane of the fabric.

In some embodiments, it is desirable to limit that portion of machine direction components which are made of polyphenylene sulphide or a blend of polyphenylene sulphide and polyamide 66 to specific regions within the width of the fabric located such that they would coincide with localized areas of severe degradation that generally extend in the machine direction.

In some embodiments, it is desirable to limit that portion of machine direction components which are made of polyphenylene sulphide or a blend of polyphenylene sulphide and polyamide 66 to that surface of the fabric which has the most severe degradation. One fabric design of this type is described in U.S. Pat. No. 2,260,940.

In another preferred embodiment the dryer fabric comprises a multiplicity of helical coils connected together by hinge pins wherein at least the helical coils are made from polyphenylene sulphide or a blend of polyphenylene sulphide with heat-stabilized polyamide 66.

In another preferred embodiment, the dryer fabric comprises a multiplicity of helical coils connected together by hinge pins wherein at least the helical coils are made from polyphenylene sulphide or a blend of polyphenylene sulphide with heat-stabilized polyamide 66 and wherein the helical coils have an essentially rectangular cross-section, when viewed in the machine direction, with the long axis of the rectangle lying in the plane of the fabric.

According to a still further broad aspect of the present invention, there is provided a dryer fabric for use in a dryer section of a paper machine wherein at least a portion of the machine direction components of the fabric are monofilaments made from polyphenylene sulphide.

According to a still further broad aspect of the present invention, there is provided a synthetic industrial fabric comprising a plurality of interwoven warp and weft monofilament strands made from polyphenylene sulphide.

According to a still further broad aspect of the present invention, there is provided a dryer fabric for use in a dryer section wherein at least a portion of the machine direction components of the fabric are made from monofilaments composed of a blend of polyphenylene sulphide and an additive which imparts toughness to the monofilament without substantially reducing the hydrolysis resistance inherent in polyphenylene sulphide. The additive has characteristics of a higher melt viscosity than the polyphenylene sulphide at extrusion temperatures, resistance to thermal degradation at extrusion temperatures, and chemical compatibilty with the polyphenylene sulphide. The additive is also present in small discrete elongated globules with the long axis of the globules being parallel to the axis of the monofilament.

Monofilaments of the type described above can also be used to advantage in other industrial applications where hydrolysis is encountered.

BRIEF DESCRIPTION OF DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE INVENTION

Figure 1:
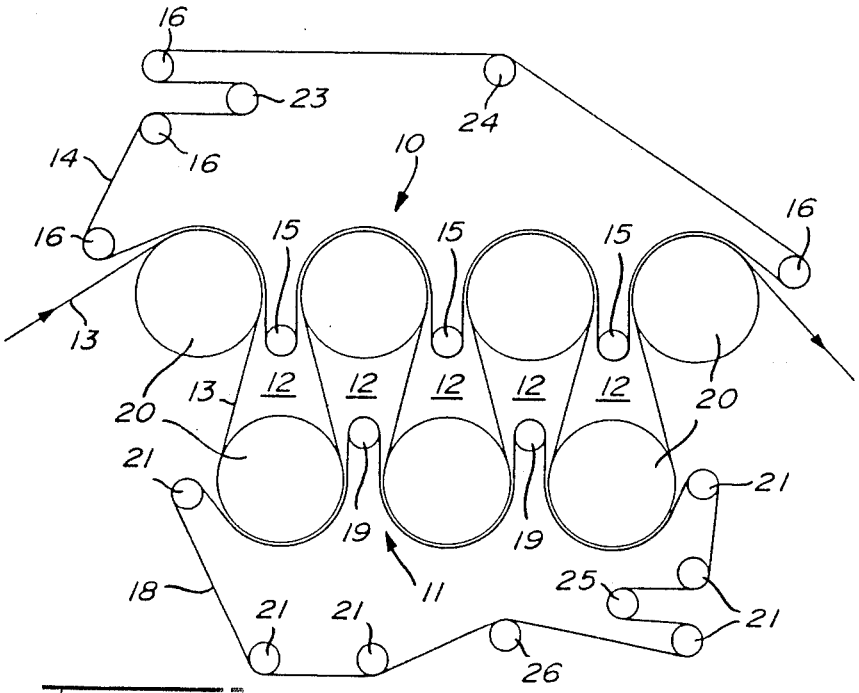
FIG. 1 is a schematic view of a typical dryer section as used in a papermaking machine.

Referring to FIG. 1, there is schematically illustrated a sub-section of a typical dryer section in a papermaking machine (not shown). The top tier dryer cylinders are generally indicated at 10 and the bottom tier at 11. The paper web 13 passes in a serpentine fashion over the top and bottom dryer cylinders as shown. An endless top fabric 14 holds the paper web 13 tightly against the upper cylinders 10 as it passes partially around the first upper cylinder, around a felt roll 15, partially around the remaining top cylinders 10 and around the other intervening felt rolls 15, then around return roll 16, passing over guide and tensioning rolls 24 and 23 respectively, and then over other return rolls 16 before it passes again over the first dryer cylinder to complete the cycle. Similarly, an endless bottom fabric 18 holds the paper web 13 tightly against the lower dryer cylinders 11 as it passes around these and the intervening bottom felt rolls 19, return rolls 21, tensioning roll 25, guide roll 26, and other return rolls 21, substantially as shown.

Polyphenylene sulphide is a linear high molecular weight polymer having the repeating unit

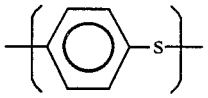

and is available commercially under the registered trademark RYTON from Phillips Chemical Corporation. While priced at a fraction of the material of U.S. Pat. No. 4,359,501, pure polyphenylene sulphide of the present invention is difficult to extrude. It is also lacking in "toughness" required for industrial weaving.

We have found that monofilament polyphenylene sulphide has greatly superior resistance to hydrolytic degradation than the polyester strands commonly used in dryer fabrics. Table 1 shows the results of a test with the percent retained tensile strength of a polyphenylene sulphide strand exposed to saturated steam at 130° C. in a pressure vessel (24 gauge psi) for a period of eight days, along with a polyester monofilament strand of the same size.

TABLE 1

| | Percent Retained Tensile Strength saturated steam at 130° C. | |
|---|---|---|
| Days | Polyphenylene Sulphide | Polyethylene Terephthalate |
| 0 | 100% | 100% |
| 1 | 123 | 95 |
| 2 | 137 | 87 |
| 3 | 130 | 66 |
| 4 | — | 35 |
| 7 | 134 | 0 |
| 8 | 132 | |

Table 2 shows test results for the same materials when exposed to saturated steam at 150° C.:

TABLE 2

| Days | Percent Retained Tensile Strength saturated steam at 150° C. Polyphenylene Sulphide | Polyethylene Terephthalate |
|---|---|---|
| 0 | 100% | 100% |
| 1 | 128 | 64 |
| 2 | 119 | 0 |
| 3 | 132 | |
| 6 | 123 | |
| 9 | 114 | |
| 12 | 122 | |
| 15 | 125 | |

It will be observed that in these accelerated tests the strength of the polyphenylene sulphide strand was not only retained but was, in fact, enhanced whereas the polyester strand showed a rapid and catastrophic loss in strength. This extraordinary retention of hydrolysis resistance, even after prolonged exposure, makes polyphenylene sulphide an outstanding candidate material for use in paper machine dryer fabrics, particularly in high-temperature applications.

Unfortunately, the material can only be extruded with difficulty in monofilament form in the size range commonly used in dryer fabrics. Also, during weaving the pure material is subject to frequent warp breakages due to its lack of toughness and is prone to scraping in the loom heddles and reed dents, all of which renders pure polyphenylene sulphide difficult for heavy industrial weaving.

The addition of a heat-stabilized polyamide 66 to the polyphenylene sulphide before extrusion has greatly alleviated these problems. Experiments in a range of blends have confirmed the following important results:

1. the addition of polyamide 66 acts as a processing aid, which makes the commercial extrusion of the blend a more viable process;

2. "toughness" is significantly enhanced. For example, the addition of 6% by weight of heat-stabilized polyamide 66 increased the measured knot toughness by a factor of seven times. This property is determined by subjecting a strand, which contains a simple overhand knot, to tensile pull and producing a resulting loadelongation diagram. The area under the curve is a measure of knot toughness;

3. full hydrolytic degradation resistance is retained;

TABLE 3

| Days | Percent Retained Tensile Strength saturated steam at 150° C. Polyphenylene Sulphide | 94% Polyphenylene Sulphide 6% Polyamide 66 | Polyethylene Terephthalate |
|---|---|---|---|
| 0 | 100% | 100% | 100% |
| 1 | 120 | 100 | 64 |
| 2 | 119 | — | 0 |
| 5 | 122 | 101 | |
| 6 | 119 | 104 | |
| 9 | 120 | 93 | |
| 12 | 110 | 107 | |
| 19 | 126 | 108 | |

4. there is no sacrifice in tensile strength when the polyamide is added to the pure polyphenylene sulphide;

5. subsequent pilot plant and commercial weaving in a wide range of dryer fabric designs, including those requiring high weaving tensions and high pick counts, confirms that the use of the polyphenylene sulphide/6% polyamide blend in warp strands of dryer fabrics reduced warp breakage and scraping to an acceptable level;

6. increasing the polyamide 66 from 6% to 20% increases the toughness of the monofilament, however the abrasion resistance decreases.

The means by which the additive improves toughness while preserving hydrolysis resistance is not entirely known, but the successful monofilaments are characterized by having the additive material present in small, discrete, elongated globules with the long axis parallel to the axis of the monofilament. These discrete globules are not connected to each other or to the outer boundaries of the monofilament, and are thus protected from the harsh environment of the end use application of the monofilament. In order to preserve the additive as discrete globules, we have found that the melt viscosity of the added material must be higher than the melt viscosity of polyphenylene sulphide at the extrusion temperature and the amount of additive must be limited. Another factor to consider in choosing the additive is that it must not degrade during extrusion when it is temporarily exposed to the temperature required to melt the polyphenylene sulphide, the range being 285° C. to 315° C. Some additives which satisfy the above-mentioned requirements do not form globules because they are chemically incompatible with polyphenylene sulphide and react in unsuitable ways.

In our experiments in blending to date, we have found that heat-stabilized polyamide 66 is the only additive to polyphenylene sulphide which successfully imparts the quality of toughness to the resultant monofilament while preserving hydrolysis resistance. Other materials may be found which can also impart the same quality to the blend. Some factors which are important in choosing additives are: a higher viscosity at extrusion temperature than polyphenylene sulphide, chemical compatibility, resistance to heat degradation during extrusion.

All types of dryer fabrics having monofilaments in the machine direction will benefit in resistance to hydrolysis from this invention. The size of monofilaments in general use in dryer fabrics lies within the range from 0.0040 inches to 0.0600 inches and most often in the range from 0.0078 inches to 0.0400 inches. Three preferred constructions utilizing rectangular machine direction components are described below but the invention is not limited to these constructions.

Figure 2:
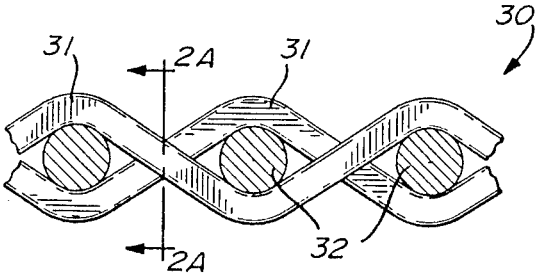
FIG. 2 is an enlarged sectional view of an all-monofilament plain weave dryer fabric utilizing flattened warp strands.
Figure 2A:
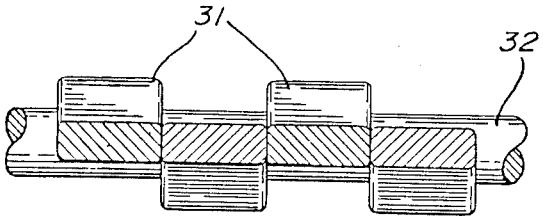
FIG. 2A is a fragmented sectional view along section line A—A of FIG. 2.

FIGS. 2 and 2A depict a plain weave dryer fabric 30 representative of a single-layer dryer fabric used in the papermaking industry. In FIGS. 2 and 2A numeral 31 denotes consecutive warp strands made from polyphenylene sulphide or a blend of polyphenylene sulphide and polyamide 66 flattened to an essentially rectangular cross-section; and numeral 32 represents consecutive weft strands. In this structure, each warp strand 31 passes over a first weft strand 32, under the second weft strand, over the third and so on. Similarly, the adjacent warp strand passes under the first weft, over the second, under the third and so on.

Figure 3:
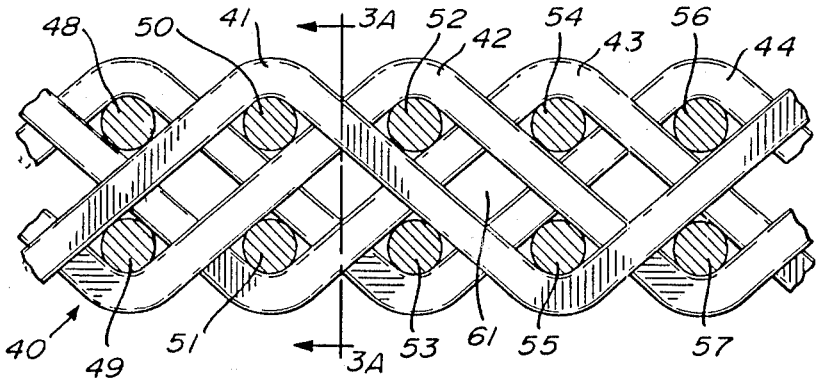
FIG. 3 is an enlarged sectional view of an all-monofilament four-shaft eight-repeat duplex-weave dryer fabric utilizing flattened warp strands.
Figure 3A:
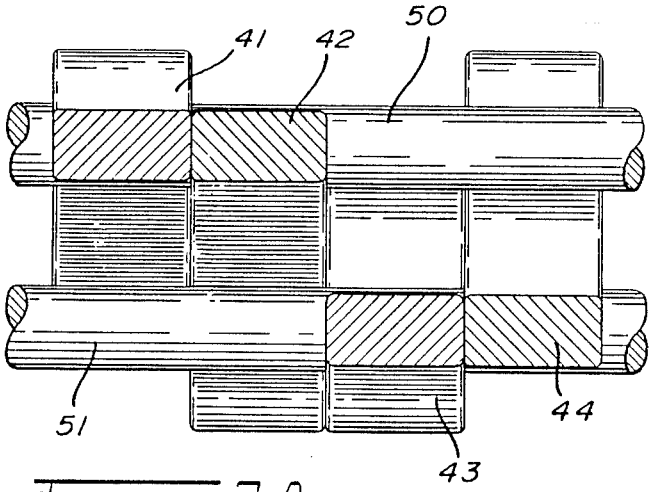
FIG. 3A is a fragmented sectional view along cross-section line A—A of FIG. 3.

FIGS. 3 and 3A depict a four-shaft eight-repeat duplex-weave dryer fabric 40, which is a type commonly used in the papermaking industry. In FIGS. 3 and 3A, numerals 41, 42, 43 and 44 are consecutive warp strands, made from polyphenylene sulphide or a blend of polyphenylene sulphide and polyamide 66, flattened to an essentially rectangular cross-section. The weft is paired in two layers and numbered 48 to 57 as shown. In this woven structure a warp strand 41 passes in sequence over a pair of weft strands 50–51, between the next pair 52–53, under the third pair 54–55, between the fourth pair 56–57, and so on. The next consecutive warp strand 42 passes between the first pair of weft strands 50–51, over tne second pair, between the third pair and under the fourth pair. Similarly, the third and fourth consecutive warp strands 43 and 44 are woven commencing under and between the first pair of weft strands respectively.

Figure 4:
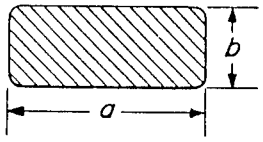
FIG. 4 is an enlarged cross-section view of the flattened warp strand.

FIG. 4 depicts the essentially rectangular cross-section of the polyphenylene sulphide or polyphenylene sulphide/polyamide blend warp strands. Such strands may be produced by rolling round monofilament strands, or by slitting film, or, in the preferred embodiment by melt-extruding through a specially shaped die. The flatness ratio a:b of the preferred embodiment shown in FIG. 4 is 2:1 and is preferably between 1.5:1 and 2.5:1 for the woven dryer fabric embodiments.

Figure 5:
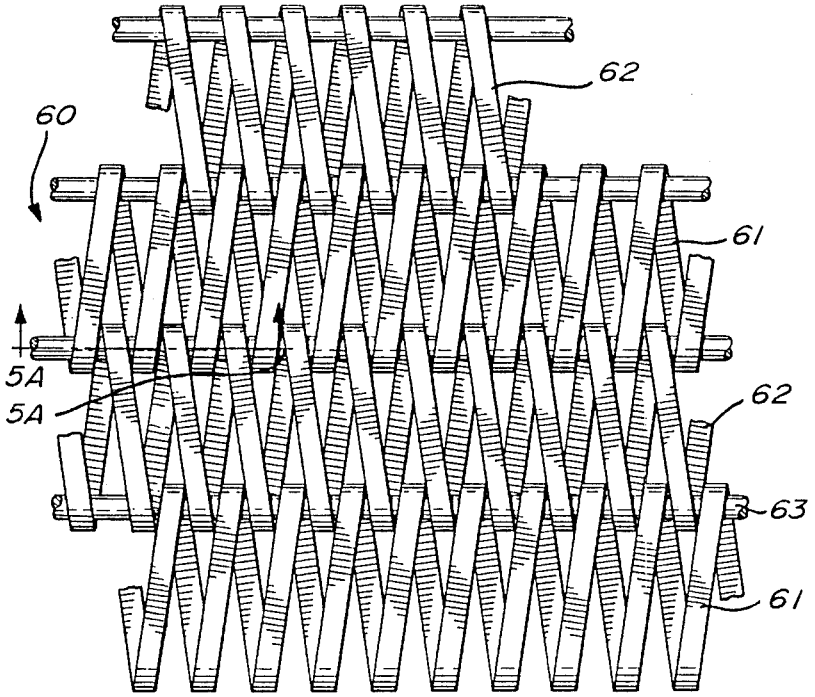
FIG. 5 is a plan view of a part of a spiral dryer fabric with flattened spirals.
Figure 5A:
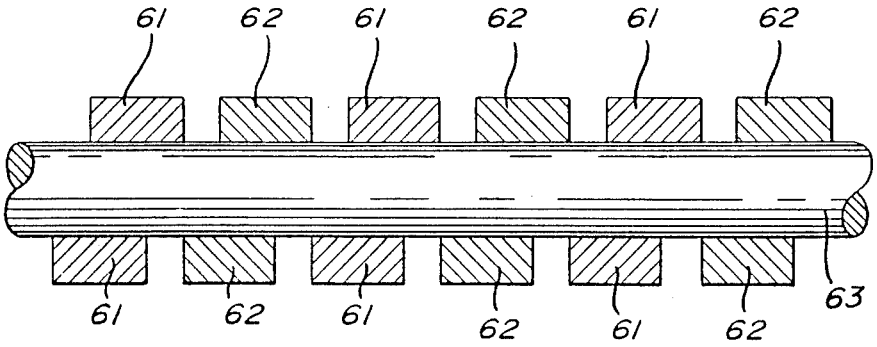
FIG. 5A is an enlarged sectional view, along cross-section line A—A of FIG. 5, of the spiral fabric viewed in the machine direction.

FIGS. 5 and 5A depict a spiral construction dryer felt 60 comprising a plurality of helical S-coils 61 joined together with adjacent Z-coils 62 by means of hinge pins 63. The designations 'S' and 'Z' indicate the direction of twist, following the convention in the textile industry. The coils 61, 62 are wound using polyphenylene sulphide or polyphenylene sulphide/polyamide blend strand material of essentially rectangular cross-section with a flatness ratio a:b of 2:1 as shown in this preferred embodiment. In this construction, a range of flatness ratios between 1.1:1 and 2.5:1 can be used.

The woven dryer fabric of the present invention has a warp count preferably in the range of 25 to 80 strands per inch. At least a portion of the warp strands are made from polyphenylene sulphide or a blend of polyphenylene sulphide and polyamide 66. The flattened warp strands of the invention will have major axis measurements in the range of 0.0125" to 0.050". With respect to weft, it is not intended to limit the material utilized to monofilaments. Since in the fabric of the invention the weft strands are non-loadbearing, other materials resistant to high temperature and hydrolytic degradation may be utilized, for example, composite strands incorporating asbestos or fiberglass.

The dryer fabric of spiral construction, which is another embodiment of the invention, utilizes helical coils made from polyphenylene sulphide or a blend of polyphenylene sulphide and heat-stabilized polyamide 66 up to 20% by weight of polyamide 66. Hinge pins may be made from the same material or alternatively from other temperature resistant materials such as the composite constructions already mentioned.

In the preferred embodiments above, rectangular shaped monofilaments have been used, but round monofilaments and other cross-sectional shapes may also be used provided at least a portion of them are made from the material of this invention. We have found that woven fabrics made with rectangular warp strands of pure polyphenylene sulphide, and in a different test with warp strands made from a 6% blend of polyamide 66 and polyphenylene sulphide, have superior resistance to distortion compared to equivalent fabrics made with monofilament polyester warp material. Thus, the invention can be used to improve the distortion resistance of fabrics made with round monofilaments which is normally troublesome.

It is within the ambit of the present invention to cover any obvious modifications of the examples of the preferred embodiment described herein provided such modifications fall within the scope of the appended claims.

We claim:

1. A dryer fabric for use in a dryer section of a paper machine, comprising a woven fabric or a fabric of a plurality of helical coils connected together by hinge pins, wherein at least a portion of the machine direction components of the fabric are made from monofilaments composed of a blend of polyphenylene sulfide and from an effective amount to up to about 20% by weight of an additive which imparts toughness to the monofilament without substantially reducing the hydrolysis resistance inherent in polyphenylene sulfide, said additive having a higher melt viscosity than the polyphenylene sulfide at extrusion temperatures, resistance to thermal degradation at extrusion temperatures, and chemical compatibility with said polyphenylene sulfide, and wherein said additive is present in small discrete elongated globules with the long axis of said globules parallel to the axis of the monofilament.

2. The dryer fabric as claimed in claim 1, wherein said additive is a heat-stabilized polyamide 66.

3. The dryer fabric as claimed in claim 2 wherein said polyphenylene sulphide is blended with about 6% by weight of heat-stabilized polyamide 66.

4. The dryer fabric as claimed in claim 2 wherein said machine direction components are warp strands in a woven dryer fabric.

5. The dryer fabric as claimed in claim 4 wherein said warp strands are flattened warp strands having an essentially rectangular cross-section with the long axis of the rectangle lying in the plane of said fabric.

6. The dryer fabric as claimed in claim 5 wherein said woven dryer fabric has flattened warp strands having an essentially rectangular cross-section with a flatness ratio between 1.5:1 and 2.5:1.

7. The dryer fabric as claimed in claim 2 wherein said machine direction components comprise a plurality of helical coils connected together by hinge pins.

8. The dryer fabric as claimed in claim 7 wherein the monofilament of said helical coils has an essentially rectangular cross-section when viewed in the machine direction with the long axis of the rectangle lying in the plane of said fabric.

9. The dryer fabric as claimed in claim 8 wherein said rectangular cross-section has a flatness ratio between 1.1:1 and 2.5:1.

10. The dryer fabric as claimed in claim 1, which comprises a plurality of interwoven warp and weft strands, wherein at least a portion of the warps are monofilaments made of a blend of polyphenylene sulfide with heat-stabilized polyamide 66, said warp strands having an essentially rectangular cross-section with the long axis of the rectangle lying in the plane of the fabric.

11. The dryer fabric as claimed in claim 1, wherein said monofilaments have a size of about 0.0040–0.0600 inches.

12. The dryer fabric as claimed in claim 11, wherein said monofilaments have a size of about 0.0078–0.0400 inches.

13. The dryer fabric as claimed in claim 1, wherein said fabric has a warp count in the range of 25–80 strands per inch.

14. The dryer fabric as claimed in claim 1, wherein said fabric has flattened warp strands having a major axis measurement in the range of 0.0125–0.050 inches.

15. A synthetic industrial fabric having excellent toughness and low breakage, said fabric comprising a woven fabric or a fabric of a plurality of helical coils connected together by hinge pins, wherein at least a portion of the machine direction components of the fabric are made from monofilaments composed of a blend of polyphenylene sulfide and heat-stabilized polyamide 66, said heat-stabilized polyamide 66 being present in an effective amount to of up to about 20% by weight, said heat-stabilized polyamide 66 being present to effect said enhanced toughness and low breakage.

* * * * *